United States Patent [19]

McCoy

[11] 4,109,039

[45] Aug. 22, 1978

[54] CARPET BACKING WITH RUBBER LATEX-SOLID POLYVINYL CHLORIDE RESIN COMPOSITION

[75] Inventor: Robert H. McCoy, Cheshire, Conn.

[73] Assignee: Uniroyal, Inc., New York, N.Y.

[21] Appl. No.: 736,025

[22] Filed: Oct. 27, 1976

[51] Int. Cl.[2] ..... D05C 17/02; B32B 27/30

[52] U.S. Cl. ..... 428/95; 427/385 R; 427/390 R; 427/390 D; 428/96; 428/327

[58] Field of Search ..... 427/385 R, 390 R, 390 D; 428/95, 96, 327

[56] References Cited

U.S. PATENT DOCUMENTS

| | | | |
|---|---|---|---|
| 3,041,707 | 7/1962 | Perri | 428/96 |
| 3,470,116 | 9/1969 | Praetzel et al. | 260/869 |
| 3,661,691 | 5/1972 | Slosberg | 428/96 X |
| 3,689,355 | 9/1972 | Hornbaker et al. | 428/96 X |
| 3,920,459 | 11/1975 | Allen | 106/15 FP |

FOREIGN PATENT DOCUMENTS

| | | | |
|---|---|---|---|
| 1,418,464 | 12/1975 | United Kingdom | 428/96 |

*Primary Examiner*—Harry J. Gwinnell
*Attorney, Agent, or Firm*—James J. Long

[57] ABSTRACT

Polymeric blends comprising a rubber latex and large particle size solid polyvinyl chloride resin provide good tuft lock in tufted carpets and enhance flame retardancy of same. The blend is applied to the carpet and dried at an elevated temperature below the flux temperature of the polyvinyl chloride resin.

11 Claims, No Drawings

CARPET BACKING WITH RUBBER LATEX-SOLID POLYVINYL CHLORIDE RESIN COMPOSITION

This invention relates to a method of making a carpet, particularly to the use of a non-foamed rubber latex composition containing large particle size polyvinyl chloride resin as a means for backsizing a carpet, specifically to provide good tuft lock and adhesion while inherently reducing flammability of the carpet.

The prior art is exemplified by the following:

U.S. Pat. No. 2,713,040, Brass et al., July 12, 1955, teaches a method of strengthening articles made from cold GR-S Latex by inclusion of PVC (polyvinyl chloride) latex having an average particle size of 100 to 200 Angstroms. In column 2, lines 16 et seq. it is stated, "Polyvinyl chloride latices of average particle size diameter above 2,000 A do not give the large increases in tensile strength of the deposited films that are obtained with the polyvinyl chloride latices of smaller particle size".

U.S. Pat. No. 3,238,172, Talalay et al., Mar. 1, 1966, discloses a method of producing an "internally-reinforced latex". An aqueous dispersion of resinous polymer (e.g., PVC) is mixed with a butadiene hydrocarbon polymer latex (e.g., SBR latex), the mixture frozen, and then thawed. The latex formed by this method "is useful for any application for which latices have heretofore been used, such as in the manufacture of foam rubber, dipped rubber articles and cast rubber articles". The resinous polymer should have an average particle size of less than 2,000 Angstroms (0.2 microns).

U.S. Pat. No. 3,661,691, Slosberg, May 9, 1972, discloses a secondary backing sheet for flame-resisting carpets composed of carboxylated vinyl resins (e.g., vinyl chloride). The vinyl resins may contain synthetic elastomers or rubber compatible with the vinyl resin in amounts up to 60% of the resin present. "Typical elastomeric polymers which may be employed would include the curable liquid acrylonitrile-butadiene and acrylonitrile-diene rubbers and carboxylated nitrile rubbers". Carboxylated SBR is not mentioned. The resin is used as a plastisol or organosol formulation. Latices of rubber are not mentioned, nor is the average particle size of the resin. British patent Specification No. 1,418,464, International Synthetic Rubber Co., Dec. 17, 1975, discloses a process for preparing solid rubber latex foam exhibiting increased hardness, comprising compounding a rubber (e.g., SBR) latex with PVC powder, foaming the latex, and drying it. The PVC particles are 0.25 - 10 microns (2500 - 100,000 Angstroms) in size. Fire-retardant compositions are disclosed; also carpet backing. In contrast, the present invention employs large particle size PVC resin to replace part of the rubber latex in a solid carpet backing that is unexpectedly characterized by remarkably good physical properties.

In accordance with one aspect of the invention, dry polyvinyl chloride resin can be partially substituted for carboxylated styrene-butadiene latex in a carpet laminating compound without any loss in carpet properties. This is in contrast to blends of polyvinyl chloride latex with carboxylated styrene-butadiene latex, which do not provide the degree of tuft bind observed with the present invention. The present polymer blend finds particular use in carpet scrim lamination where additional fire resistance is required without loss of other properties. This polymer blend can be used in preparing a frothable carpet laminant, the froth being subsequently crushed after application, to a non-foamed state.

The invention minimizes toxicity problems associated with the use of polyvinyl chloride latex, and makes possible substantial economies.

A typical carpet compound of the invention for laminating a primary to a secondary backing is as follows:

| | |
|---|---|
| Rubber latex - PVC resin | 100 parts (dry) |
| Filler dispersant | 0.5 - 3 parts |
| Filler | 350 parts |
| Thickeners | 0.2 - 1.0 part |
| Water to | 73% solids |

The filler dispersants typically are from the family pyrophosphates. Most frequently tetrapotassium pyrophosphate or tetrasodium pyrophosphate is used to stabilize the latex to the calcium ion of the filler.

The thickeners are typically sodium polyacrylates such as the Wica's (trademark), Paragum's (trademark) or Alcogum's (trademark). The thickener is added to increase the viscosity of the carpet compound to prevent filler fallout and to control handling and application. The filler is typically whiting and/or alumina hydrate. It is used for weight and cost.

The solids of a carpet compound is adjusted by adding water to a level where handling is practical, performance is good and economics of running are acceptable.

In accordance with the invention the ratio of latex rubber (dry) to large particle size non-latex solid PVC resin powder may range from 90/10 to 50/50, preferably from 85/15 to 55/45, most preferably from 80/20 to 70/30 by weight. The PVC may have a particle size of from greater than 10 to 350 microns (50 - 250 preferred, 70 - 200 most preferred). As indicated above, in addition to the two principal components, latex extenders or fillers generally are used such as clay, aluminum hydrates, calcium carbonate and other materials commonly employed for that purpose. The level of such filler may be from 100 to 1,000 parts per 100 parts of (dry) rubber plus PVC, usually 150 to 800 and most preferably 200 to 500 parts.

As mentioned before the blend of this invention is usually applied to the backside of a carpet in a non-foamed state. As a matter of fact it would be rather difficult to produce a foamed product from the blends of this invention. Yet, in some instances, especially where better weight or volume control is desired, the blend may be frothed, the frothed blend then being applied to the carpet back in an amount controlled by, e.g., a doctor blade or roller. Subsequently the froth is crushed to a substantially non-cellular state. The amount of dry weight of the blend applied generally varies from 18 to 50 ounces per square yard of carpet. One skilled in the art will recognize that the actual amount suitable will depend on the face weight and construction of the carpet. For instance a shag type rug may require 30 - 36 oz./yd.$^2$, whereas a level loop carpet may need only 18 - 28 oz./yd.$^2$. The amount should in any case be sufficient to provide effective tuft lock.

As the rubber latex, any suitable conventional rubber latex usually used for application to the back of a carpet may be employed, whether a natural rubber latex or a synthetic rubber latex. Among the synthetic rubber latexes, there may be mentioned latexes of rubbers derived from conjugated dienes, such as butadiene, isoprene, chloroprene, etc., whether homopolymers of such dienes, or copolymers of such dienes with one or more copolymerizable ethylenically unsaturated monomers such as styrene, alphamethylstyrene, acrylonitrile, methacrylonitrile, acrylic acid, methacrylic acid, itaconic acid, etc. Of special interest are the copolymers of butadiene or the like with styrene, modified by including minor amounts of a polar monomer, e.g., an ethylenically unsaturated organic acid such as acrylic acid, itaconic acid (or an ester of such carboxylic acid, such as an alkyl ester), as well as acrylamides, vinyl ethers or alkyl vinyl esters, also amines such as vinyl pyridine and halogen containing monomers such as vinyl chloride or vinylidene chloride.

One class of latex of particular interest is that known as carboxylated latex or acid latex. These include copolymers (in which term we include interpolymers containing two or more monomers) of conjugated dienes with one or more monoethylenically unsaturated copolymerizable monomers, at least one of which has carboxyl functionality, whether a monocarboxylic acid or a polycarboxylic (e.g., dicarboxylic) acid, such as itaconic acid, acrylic acid, methacrylic acid, fumaric acid, citraconic acid, maleic acid, ethyl acid maleate, etc.

In practicing the invention the described rubber latex carpet backing composition containing the solid large particle size polyvinyl chloride resin uniformly admixed therein is spread (if desired in the form of a froth which is later crushed) or applied to the back of a carpet by any suitable conventional method. The carpet may otherwise be of conventional construction, and is usually of the tufted kind. The tufts may be made of any appropriate conventional fiber, whether natural or synthetic (e.g., cotton, wool, nylon, polyester, acrylic) and may include fabric backing similarly composed of any natural or synthetic fiber (e.g., cotton, jute, hemp, polypropylene, etc.) conventionally used for this purpose. The thus-coated carpet is subsequently dried, ordinarily at a suitable elevated temperature, to leave a solid, dry, nonfoamed deposit composed of the rubber residue from the latex and the polyvinyl chloride resin. The drying temperature should be below the softening or flux temperature of the polyvinyl chloride resin, for optimum tuft lock.

Among the surprising and unexpected advantages made possible by the invention there may be mentioned good carpet properties, particularly excellent tuft lock and adhesion, with reduced flammability of the carpet. The process of the invention can be carried out economically and avoids toxicity hazards associated with the use of polyvinyl chloride latex.

The following examples, in which all quantities are expressed by weight unless otherwise indicated, will serve to illustrate the practice of the invention in more detail.

EXAMPLE I

To a butadiene (50% wt.) — styrene (49%) — itaconic acid (1%) terpolymer latex (50% solids) is added poly(vinyl chloride) and filler (Georgia Whiting #9) at various concentrations indicated in Table I. The PVC resin has a weight average particle size of about 150 microns and a relative viscosity of 2.25 (1% wt. concentration in cyclohexanone at 25° C.). All blends contained about 0.5 parts (dry) of a sodium polyacrylate thickener sufficient to achieve a latex blend viscosity of about 12,000 cps. After thorough mixing the latex blend is applied to the back of a tufted carpet having a polypropylene backing and tufts made from nylon. The amount of (dry) latex composition spread over the carpet backing is about 28 oz./yd.$^2$. The resultant composition is dried at 260° F. for 20 minutes after which the tuft bind (or tuft lock) of the laminate is measured according to ASTM method D-1335. The recipes and results are summarized in Table I. The data indicate that with the addition of PVC resin the tuft bind is not only at least maintained but in most cases unexpectedly increased over the standard runs not containing any resin.

TABLE I

| | LATEX BACK-SIZED CARPET | | | | | | | |
|---|---|---|---|---|---|---|---|---|
| Run No. | 1* | 2 | 3 | 4 | 5* | 6 | 7 | 8 |
| Latex (dry), parts | 100 | 85 | 70 | 55 | 100 | 85 | 70 | 55 |
| PVC resin, parts | — | 15 | 30 | 45 | — | 15 | 30 | 45 |
| Whiting, parts | 200 | 200 | 200 | 200 | 375 | 375 | 375 | 375 |
| Total solids, % | 70 | 70 | 70 | 70 | 75 | 75 | 75 | 75 |
| Tuft bind, lbs. | 11.3 | 12.4 | 14.3 | 13.1 | 11.4 | 11.4 | 12.7 | 12.6 |

*Runs 1 and 5 are outside the invention

EXAMPLE II

In this example the effect of PVC particle size on tuft bind is investigated. A rubber latex essentially as in Example I is blended with PVC resins having weight average particle sizes ranging from about 10 to 150 microns as indicated in Table II. All runs contain filler (Georgia Whiting #9) at the 200 parts per 100 parts of dry polymer (rubber plus PVC) level. The non-frothed latex is applied to the back of a carpet similar to that in Example I, after which the construction is dried. All PVC containing latices exhibit improved tuft lock when dried at 260° F. (for 20 minutes), i.e., at below the softening or flux temperature of the PVC resin. This holds especially true with PVC resins having a particle size of from 85 to 150 microns. If the latex-PVC resin blends are dried at a temperature (310° F.) above the fusion point of PVC the tuft lock values generally are below that achieved with the latex not containing PVC resin.

TABLE II

| Run No. | 9 | 10 | 11 | 12 | 13 | 14 |
|---|---|---|---|---|---|---|
| Latex (dry), parts | 100 | 75 | 75 | 75 | 75 | 75 |
| PVC, PS*, microns | — | 10 | 85 | 100 | 125 | 150 |
| PVC, parts | — | 25 | 25 | 25 | 25 | 25 |
| Tuft bind (260° F.),**lbs. | 11.8 | 12.1 | 12.4 | 13.4 | 13.0 | 12.9 |
| Tuft bind (310° F.),**lbs. | 12.9 | 12.3 | 12.1 | 12.5 | 12.9 | 12.4 |

*PS = particle size

**Tuft bind after drying at 260 or 310° F. respectively, all tuft bind measurements taken at room temperature.

EXAMPLE III

A styrene (48%)—butadiene (51%) — itaconic acid (1%), all by weight, latex having 50% solids is blended with a poly(vinyl) chloride) latex (50% solids) wherein the size of the PVC particles is about 0.1–0.2 microns (Geon [trademark] 151) at a solids ratio of 75/25 by weight. The same SBR latex is blended at a 75/25 solids (i.e., rubber/PVC) ratio with the poly(vinyl chloride) resin of Run No. 13.

To the above blends (Runs No. 16 and 17 respectively) as well as the non-PVC extended rubber latex (Run No. 15 whiting) (275 parts) and alumina trihydrate [100 parts, per 100 parts of dry polymer(s)] is added. The latices are then applied to the back of a tufted carpet as described in Example I. The physical properties of the resultant laminate are summarized in Table III.

TABLE III

| Run No. | 15 | 16 | 17 |
|---|---|---|---|
| SBR Latex, parts (dry) | 100 | 75 | 75 |
| PVC Latex, parts (dry) | | 25 | |
| PVC Resin, parts | | | 25 |
| PVC, particle size, microns | | 0.1-0.2 | 125 |
| Tuft Lock, psi | 14 | 14 | 17 |

The data indicate that the tuft lock is superior to that obtained from the rubber latex alone and the blend of rubber latex and the latex containing small particle size PVC (outside this invention).

I claim:

1. A method of backsizing a carpet comprising providing an aqueous carpet backsizing composition comprising a rubber latex and solid polyvinyl chloride resin particles having a weight average particle size of from 85 to 150 microns, the weight ratio of dry rubber solids to polyvinyl chloride resin being within the range of from 85:15 to 55:45, applying the said aqueous composition to the back of the carpet, and thereafter drying the applied composition at an elevated temperature below the flux temperature of the polyvinyl chloride resin to provide a carpet backsized with the said composition in a non-cellular state.

2. A method as in claim 1 in which the aqueous backsizing composition contains from 100 to 1,000 parts of filler per 100 parts of dry weight of rubber plus polyvinyl chloride resin.

3. A method as in claim 2 in which the carpet is a tufted carpet.

4. The backsized carpet resulting from the method of claim 1.

5. A method as in claim 1 in which the said rubber is a polymer of a conjugated diolefin.

6. A method as in claim 5 in which the said diolefin is copolymerized with at least one copolymerizable monoethylenically unsaturated monomer.

7. A method as in claim 6 in which the rubber is a carboxylated rubber.

8. A method as in claim 7 in which the weight ratio of dry rubber solids to polyvinyl chloride resin is from 80:20 to 70:30, the composition contains from 200 to 500 parts of filler per 100 parts of dry weight of rubber plus polyvinyl chloride resin and the dry weight of solids deposited on the carpet from said composition is from 18 to 50 ounces per square yard of carpet.

9. A method as in claim 8 in which the rubber is a butadiene-styrene-ethylenically unsaturated carboxylic acid terpolymer.

10. A method as in claim 9 in which the said acid is itaconic acid.

11. A method as in claim 9 in which the carpet is a nylon tufted carpet.

* * * * *